United States Patent [19]

D'Arcy

[11] 4,102,071

[45] Jul. 25, 1978

[54] AUTOMATIC PAGE TURNING APPARATUS

[76] Inventor: James A. D'Arcy, 32325 Coast Hwy., South Laguna, Calif. 92651

[21] Appl. No.: 768,962

[22] Filed: Feb. 16, 1977

Related U.S. Application Data

[63] Continuation of Ser. No. 669,821, Mar. 24, 1976, abandoned.

[51] Int. Cl.[2] ..... G09F 11/06

[52] U.S. Cl. ..... 40/531

[58] Field of Search ..... 40/102, 104, 104 A; 84/487

[56] References Cited

U.S. PATENT DOCUMENTS

| | | | |
|---|---|---|---|
| 1,069,122 | 8/1913 | Friedman | 40/104 A X |
| 2,791,847 | 5/1957 | Hangman | 40/104 R |
| 2,885,806 | 5/1959 | Storm et al. | 40/104 R |
| 3,484,970 | 12/1969 | Berlinsky et al. | 40/104 R |
| 3,570,154 | 3/1971 | Cosenza | 40/104 A |
| 4,031,644 | 6/1977 | Rogers | 40/104 A |

*Primary Examiner*—Louis G. Mancene
*Assistant Examiner*—Wenceslao J. Contreras
*Attorney, Agent, or Firm*—William W. Haefliger

[57] ABSTRACT

An automatic page-turning apparatus for books, magazines and the like comprising a transparent housing having a hinged top to allow a book to be positioned in the housing and seen through the top thereof. Disposed within the housing is a slip-clutch assembly attached to an operating knob located on the exterior of the housing. A monofilament cable is interconnected to the slip-clutch assembly, and is arranged to be operably supported by a plurality of pullies, the cable including a transversely attached page-turning band, which traverses over the pages of the book to engage each succeeding page to be turned. A page-separating wheel is operably synchronized with the movement of the page turning-band to allow the band to engage the page to be turned. When the book is being read, the page-turning band acts as a page hold-down means for one side, while a separate hold-down band is used on the opposite side of the book.

24 Claims, 10 Drawing Figures

AUTOMATIC PAGE TURNING APPARATUS

This is a continuation of application Ser. No. 669,821, filed Mar. 24, 1976 and now abandoned.

BACKGROUND OF THE INVENTION

1. Field of the Invention

This invention relates generally to a book holder and reading attachment and, more particularly, to a page-turning apparatus, whereby each page of a book, magazine or the like can be turned by a simple operation.

2. Description of the Prior Art

As is well known in the art, various problems and difficulties are encountered in providing suitable devices whereby a book can be readily positioned for an individual to read without the general use of the reader's hands. There are several types of known book supports, but they are very limited in their use. Further, the known devices have no means whereby each page of the book can be turned without the direct use of the hands to do so.

As examples of known art, I refer to U.S. Pat. No. 2,638,701 wherein there is disclosed an adjustable book holder for hospital beds. The device permits a patient who is more or less extended on his back to read a book, the book being held above the patient and with its leaves turned downward. The pages or leaves to the book must be turned by the patient himself.

Again in U.S. Pat. No. 1,692,337 there is provided an adjustable book holder, but no means are shown or taught whereby the pages of the reading material can be automatically turned. The pages are held from turning by resilient clips or wires and must be manually moved to allow the pages to be turned.

U.S. Pat. No. 2,359,895 discloses a similar type of reading attachment which is very limited in use and is designed particularly as a book support.

Other book-support devices are illustrated in U.S. Pat. No. 2,677,510 and 2,317,001.

However, U.S. Pat. No. 3,343,776 does illustrate a page-turning device which comprises a platform to support an open book, said platform having an operable arm member which carries a magnet adapted to overlie a clip secured to a page of the book. The arm member includes a crank which is operatively connected to a pedal, whereby depression of the pedal rotates the crank and causes the arm to rotate. Accordingly, each page must have a clip mounted thereto. Thus, this would not be practical where a book comprises numerous pages.

SUMMARY OF THE INVENTION

The present invention comprises an automatic page-turning device which is so designed that there are many conditions under which it can operate. Most book supports are designed for invalids, the disabled, or bedridden patients, as previously mentioned heretofore. However, this is not true with the present invention, as it allows the user thereof to have his hands free to do other things, such as drink, eat, write from the readings of the book, etc. That is, once the book holder is comfortably positioned, the reader only needs to turn a simple knob whereby the apparatus automatically controls the turning of each individual page each time the knob is rotated.

In addition, because of the enclosure of the present apparatus, it can be utilized in a bathroom over a bathtub without damaging the book by soaking or wetting.

The applicant contemplates its use in various vehicles such as busses, planes, trains, or cars.

The automatic page-turning apparatus as herein presented comprises a transparent house having a hinged top which can include a magnifying glass of some type. Operably arranged within the housing and supported by a plurality of pullies is a monofilament cable having each end thereof connected to a slip-clutch assembly. The slip-clutch assembly includes a slip-clutch disc and a disc-wheel, wherein the cable ends are attached to the slip-clutch disc which causes the cable to move when rotated. The concentrically disposed disc-wheel is provided with a cam recess, which releasably holds a lever arm that operates the page-separating roller. In addition, the clutch disc has a stud which is received in an annular, limited recess formed in the adjacent disc-wheel. Both the clutch disc and disc-wheel are supported on a concentric shaft wherein the slip-clutch disc is fixed thereto and rotates therewith, while the disc-wheel is allowed to freely rotate thereon.

Thus, the slip-clutch is allowed to rotate first, before the stud engages the wheel-disc.

Accordingly, the movement of the clutch disc moves a page-turning band which is transversely secured to the cable, whereby the band traverses over the book pages to a predetermined point, at which time the clutch engages the disc-wheel operating the page-separating roller to allow the band to engage the separated page.

A knob is secured to the shaft and is simply rotated in a clockwise manner to operate the apparatus, and is then allowed to return to a normal position upon release thereof by a spring means attached to the lever arm. At this time, the page-turning band acts as a page hold-down device along with a second page hold-down band positioned adjacent the page separator.

OBJECTS AND ADVANTAGES OF THE INVENTION

The present invention has for an important object a provision wherein a book or the like is disposed in a transparent housing, whereby the pages of the book can be automatically turned by a simple rotation of a slip-clutch assembly controlled by a knob connected thereto and disposed on the outside of the housing.

It is another object of the invention to provide an automatic page-turning apparatus that is not just limited to bedridden patients, disabled individuals, etc.

It is still another object of the present invention to provide a page-turning apparatus that allows a reader to place himself in any comfortable position while reading.

It is a further object of the invention to provide an apparatus of this character that allows the book, or readable material, to be completely enclosed and safe from damage, wear and food and drink stains.

It is still a further object of the invention to provide an apparatus of this character that is easy to service, operate and maintain.

Still another object of the invention is to provide an apparatus of this character that is relatively inexpensive to manufacture.

It is still another object of the present invention to provide an apparatus of this character that is simple and rugged in construction.

The characteristics and advantages of the invention are further sufficiently referred to in connection with the accompanying drawings, which represent one embodiment. After considering this example, skilled persons will understand that variations may be made without departing from the principles disclosed and I contemplate the employment of any structures, arrangements or modes of operation that are properly within the scope of the appended claims.

DESCRIPTION OF THE DRAWINGS

Referring more particularly to the accompanying drawings, which are for illustrative purposes only:

FIG. 6 is an enlarged cross-sectional view taken along line 6—6 of FIG. 4, showing one of the guide rails and a slidable guide block connected to the cable system and page-turning band;

DESCRIPTION OF THE PREFERRED EMBODIMENT

Figure 1:
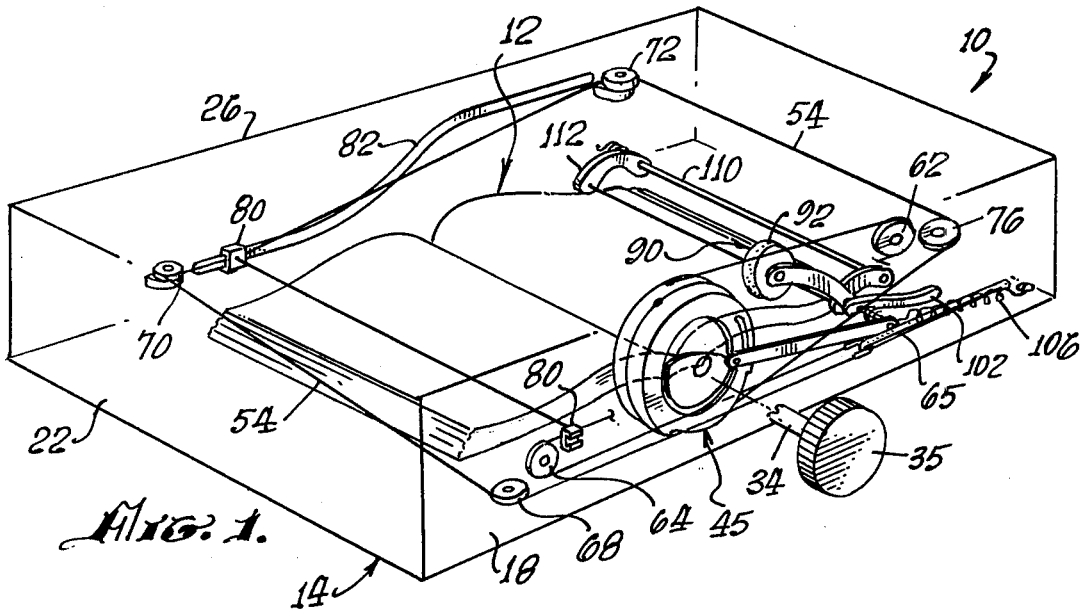
FIG. 1 is a perspective view of the present invention, illustrating a book disposed therein.

Referring more particularly to FIG. 1, there is shown an automatic page-turning apparatus, generally indicated at 10, having a book 12 positioned therein, wherein the pages are held in such a manner as to be readily read by an individual.

The automatic page-turning apparatus comprises a transparent housing 14 which can be made of any well-known, durable, clear plastic material. The housing 14 is formed by a bottom support wall 16 having a front wall 18, a rear wall 20, and side walls 22 and 24, respectively. Thus, a compartment 25 is defined thereby and can be closed and sealed by a hinged top lid 26, said lid being transparent so that one can read the enclosed book, magazine, etc., when the lid is closed.

Included within the compartment 25 and affixed therein is a partition 28, the partition being arranged adjacent and parallel to the front wall 18, whereby a second smaller compartment 30 is defined.

Operably mounted between the front wall 18 and partition 28 is a slip-clutch assembly indicated generally at 32, which is supported by a centrally disposed shaft 34 to which an operating means, such as a knob 35, is also secured. Said slip-clutch assembly comprises a slip-clutch disc 36 having a projecting stud 38 positioned adjacent the annular edge thereof, and wherein the annular circumference of the disc has a pair of annular grooves 40 and 42 formed therein to receive a cable system, which will be hereinafter described in detail. The clutch disc 36 is fixed to the shaft 34 in any suitable manner so as to rotate therewith as the knob 35 is rotated. As part of the clutch assembly, there is included a disc-wheel 45, which is freely supported on shaft 34. Said disc-wheel 45 is provided with curvilinear cam recess 46 and an annular recess 48. The annular recess is disposed along a predetermined length of the circumference of the disc-wheel, and is adapted to recess the projecting stud 38 of the clutch disc 38. In a normal reading position, stud 38 abuts the far notch 50 of said recess 48. When the knob 35 is rotated, the clutch disc 36 rotates with shaft 34, at which time stud 38 moves in recess 48 until it reaches the opposite notch 52 of said recess 48. Stud 38 engages notch 52 and rotates the disc-wheel 45 in a clockwise manner. Thus, the stud 38 together with the recess 48, provides a timing means to permit the proper sequential movement of the elements of the page-turning assembly which is operably interconnected to the slip-clutch assembly 32.

Figure 2:
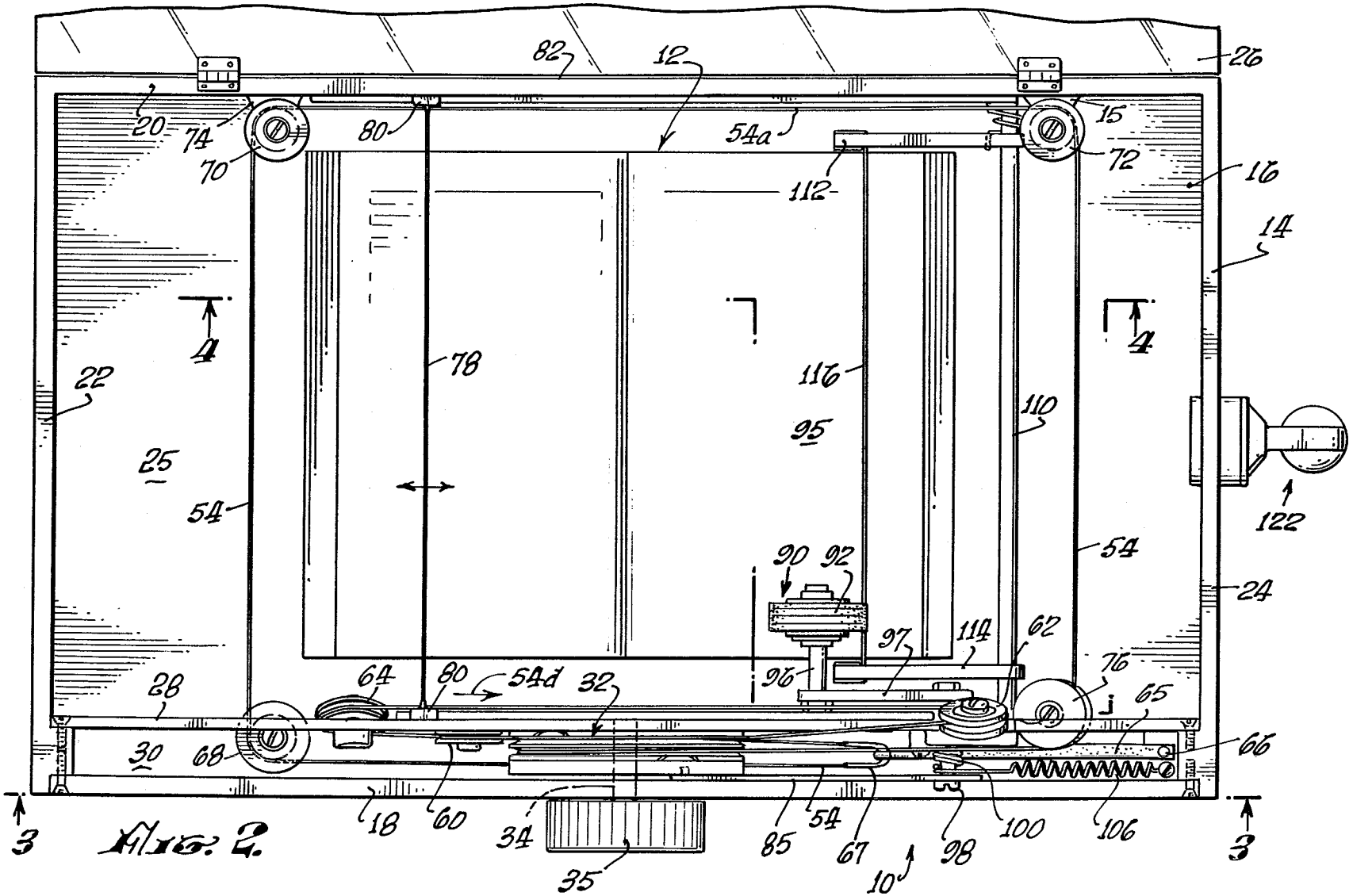
FIG. 2 is a top plan view with the transparent lid in an open position and the pages of the book being held in an open mode for reading.
Figure 3:
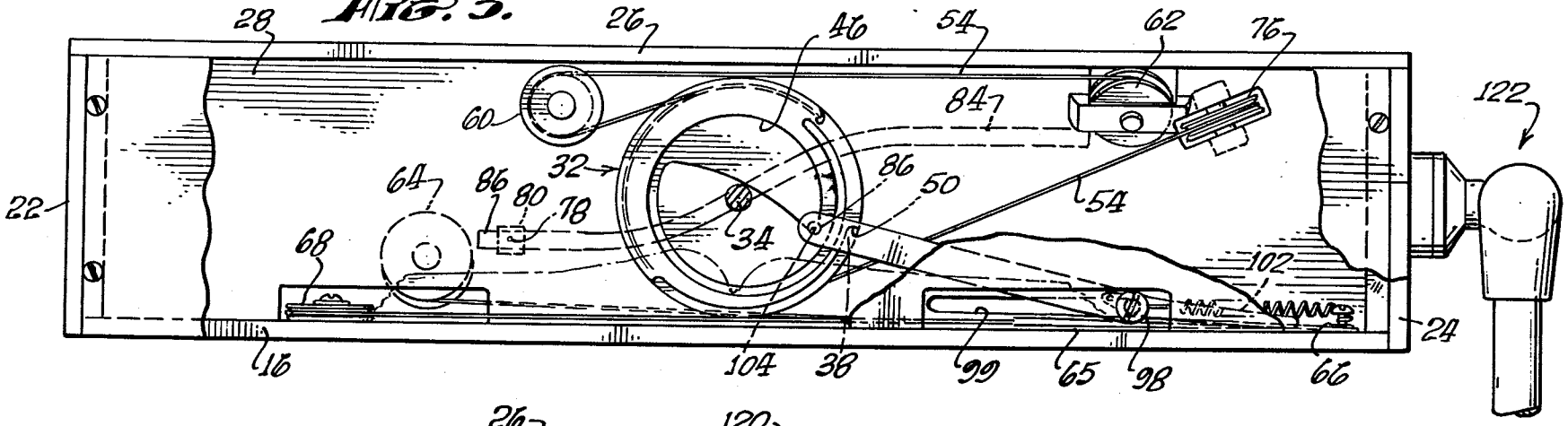
FIG. 3 is a cross-sectional view taken substantially along line 3—3 of FIG. 2 thereof, to better illustrate the slip-clutch assembly.

The page-turning assembly comprises a monofilament cable 54 whereby the free ends 56 and 58 are attached to clutch disc 36, and are received in respective annular grooves 40 and 42, so that rotation of clutch disc 36 moves the entire cable 54. The cable is arranged to extend about the compartment 25, as seen in FIGS. 1 and 2. To accomplish this, there are a plurality of pullies adapted to receive the continuous cable. Thus, the free end 56 of the cable 54 extends from groove 40 to a first pulley 60 mounted to partition 28, and from there to a second pulley 62 which is also attached to partition 28. At this point, the cable is doubled back and is attached to a third pulley 64 which again allows the cable 54 to double back so as to be attached to a biasing means, shown as a stretchable band (rubber band) 65, said band 65 being secured at its opposite end 66 to the bottom wall 16, as seen in FIGS. 2 and 3.

Figure 7:
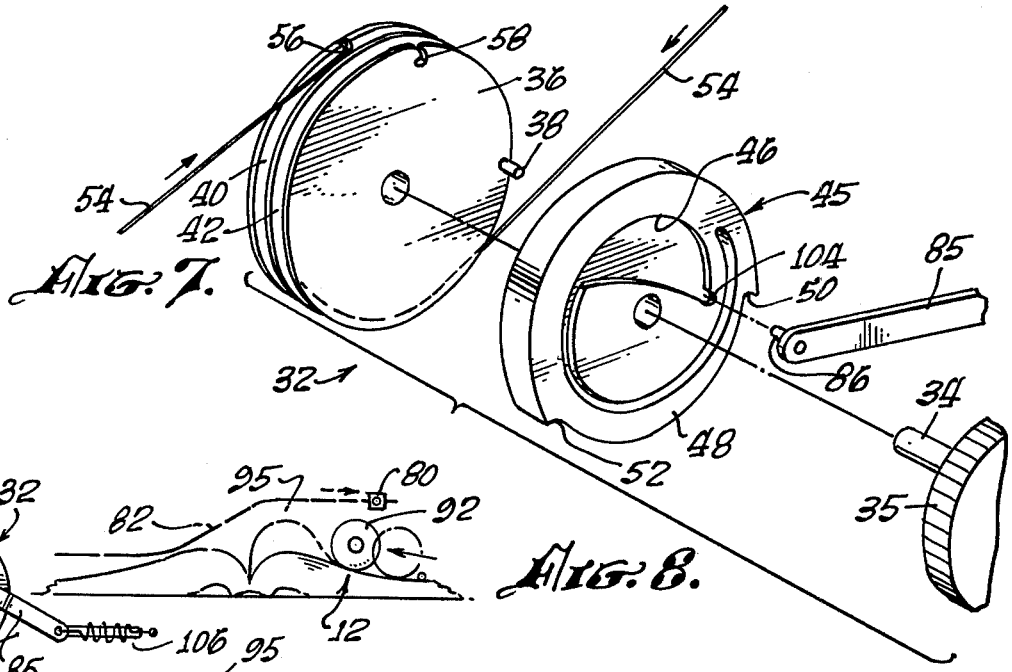
FIG. 7 is an enlarged, exploded, perspective view of the slip-clutch assembly.

A sleeve 67 having a "U"-shaped configuration is affixed to the cable where the rubber band 65 is connected thereto, allowing the cable 54 to extend to pulley 68, which is rotatably secured to bottom wall 16. From pulley 68, the cable extends transversely across compartment 25 where it engages pulley 70 and further extends longitudinally along rear wall 20 to still another pulley 72. Both pulleys 70 and 72 are attached to the rear wall 20 by arms 74 and 75, respectively. The cable 54 again traverses the width of said compartment 25 and engages pulley 76, which is arranged to permit cable 54 to enter into compartment 30, whereby the free end 58 of said cable is attached to slip-clutch disc 36, as noted in FIG. 7. Hence, when the shaft 34 is rotated by any suitable means in a clockwise direction, cable 54 is caused to move about the engaging pullies.

Accordingly, the cable 54 includes a means for turning each page individually by direct engagement therewith. The above means comprises a page-turning band or string 78 stretched transversely across compartment 25, each end thereof being attached to the oppositely disposed longitudinally positioned portions 54*a* and 54*b* of said cable, as shown in FIG. 2.

Figure 4:
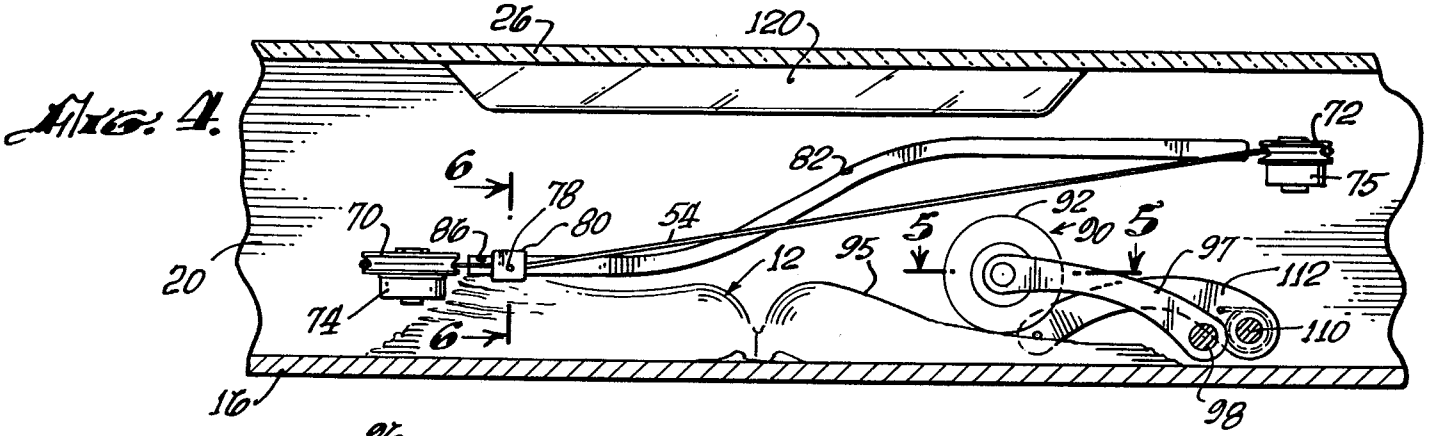
FIG. 4 is a cross-sectional view taken substantially along line 4—4 of FIG. 2.
Figure 9:
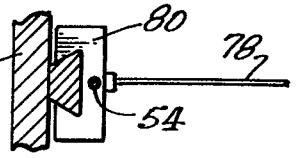

When the band 78 is positioned as seen in FIGS. 2 and 4, it acts as a page hold-down means for the left side of the book 12. The band or string 78 is attached to the cable 54 by means of slidable guide blocks 80, better seen in FIG. 6. Thus, there are two oppositely disposed guide blocks 80 affixed to cable 54, so as to travel over the book 12 when the cable is operated. Each guide block is slidably mounted to side rails 82 and 84, wherein the rails 82 and 84 are respectively affixed to wall 20 and partition 28. The rails 82 and 84 are identically designed having a somewhat curvilinear configuration, as seen in FIGS. 3 and 4. That is, each rail has a forward end 86 positioned adjacent the bottom wall 16 to allow string 78 to hold the left pages of book 12 down in an open mode. The rails extend rearward and bend upward well over the right side of book 12. This permits the page of the book to be turned with enough room to pass under the band 78, when said band is located on the rearward portion of the rails. A detailed description of the sequential turning of each page will be described herein after.

Accordingly, as shaft 34 is rotated, the slip-clutch disc rotates clockwise, moving the cable 54 about the plurality of pullies, as previously described. Hence, the arrangement of the cable with respect to said pullies causes cable sections 54*a* and 54*b* to move rearwardly together in the direction of arrows 54*c* and 54*d*, at which time band 78 moves therewith. The clutch disc 36 will then allow stud 38 to engage notch 52 of recess 48, thereby causing disc-wheel 45 to rotate. Thus, it can be seen that a lost motion is created, thereby permitting band 78 to traverse over book 12 before disc-wheel 45 starts to rotate.

Figure 8:
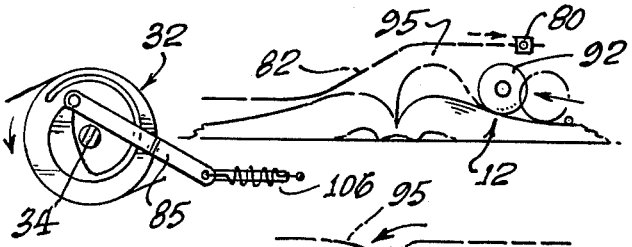
FIGS. 8, 9, and 10 are diagrammatic views illustrating the various page-turning operations with respect to the position of the slip-clutch assembly.
Figure 5:
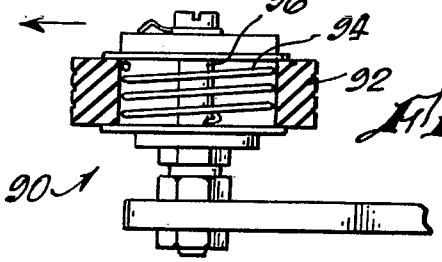
FIG. 5 is an enlarged, cross-sectional view of the page-separating roller taken along line 5—5 of FIG. 4.

When the disc-wheel 45 is caused to rotate in a clockwise manner, linking arm 85 is moved in a linear manner, said arm 85 being connected to the disc-wheel by a pin 86 which is received in cam recess 46. The arm 85 extends rearwardly from wheel 45 and is connected to a page-separating means, indicated generally at 90. The page-separating means comprises a roller 92 formed from any suitable material that will create friction between the roller and the page of the book to be turned. The roller, however, is arranged not to rotate when it is moved in a forward direction. This is accomplished by having the roller spring loaded by means of spring 94, as shown in FIG. 5. Thus, when disc-wheel 45 rotates, it causes arm 85 to slide forward, also moving roller 92 forward without the roller rotating, thereby forcing the contacting page 95 to bow upwardly and forwardly, as seen in FIG. 8. The roller 92 is supported on a shaft 96 which, in turn, is affixed to a second lever arm 97. Lever 97 is interconnected to the first lever arm by bolt 98, the bolt being adapted to be received through slot 99 in partition 28. Positioned about the bolt is a biasing spring 100 which provides the necessary engaging force of roller 92 with the pages of the book. In addition, a stabilizing leg member 102 is coupled to the spring 100 and bolt 98, to prevent binding during the operation thereof.

Figure 9:
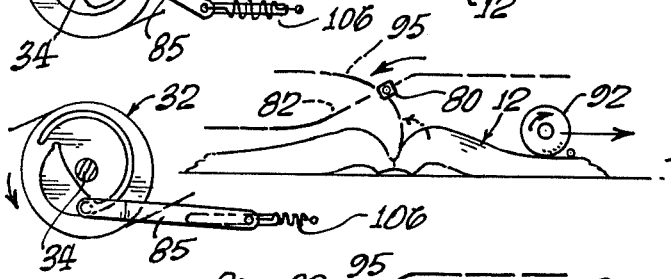

Referring to the diagram in FIG. 8, it can be seen that the slip-clutch and the disc-wheel have been fully rotated clockwise, whereby the blocks 80 have moved the band 78 rearwardly over and above page 95, at which time said roller 92 forces page 95 to separate and bow upwardly. When linkage arm 85 reaches its uppermost position, pin 86 disengages from notch 104 located in cam recess 46; and arm 85 is pulled rearwardly by biasing spring 106, thereby allowing roller 92 to return to its normal position. Because of the arrangement of roller spring 94, the roller 92 is permitted to roll rearwardly over the pages of the book; thereby, the pages are not affected during the roller's return movement. This is shown in the diagram of FIG. 9.

Figure 10:
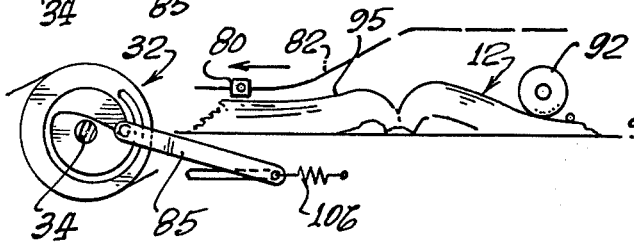

At the time roller 92 releases from page 95, said page 95 will, on its own, flex upwardly to be engaged by band 78 as the band returns to its forward position. The blocks 80, because of the contour of each rail 82 and 84, move downwardly, forcing page 95 to a substantially flat position, as seen in FIG. 10. Thus, the page-turning cycle has been completed, wherein all the elements are in their normal relationship.

It should be understood that various other means can be connected to shaft 34 to operate the apparatus as described.

In addition, the apparatus also includes a page hold-down means for the pages of the right side. The hold-down means includes a spring-biased rod 110 transversely disposed and pivotally mounted within the housing 14. Mounted to the rod 110 are oppositely disposed leg members 112 and 114 having a hold-down band 116 secured therebetween; wherein the band 116 engages the pages of the right side of the book 12 just behind the roller 92.

It is contemplated that in some cases the hinged top lid will be constructed to allow a magnifying device 120 to be mounted thereto, as shown in FIG. 4. Further, it is contemplated that an adjustable support-mounting means, generally indicated at 122, can be attached to the housing to provide the use of the apparatus under various conditions.

The invention and its attendant advantages will be understood from the foregoing description and it will be apparent that various changes may be made in the form, construction and arrangements of the parts of the invention without departing from the spirit and scope thereof or sacrificing its material advantages, the arrangement herein before described being merely by way of example, and I do not wish to be restricted to the specific form shown or uses mentioned, except as defined in the accompanying claims.

I claim:

1. An automatic page-turning apparatus for books and the like, wherein the apparatus comprises:

a housing having a plurality of walls defining a compartment wherein a book is removably disposed;

a page-separating means operable within said compartment for direct contact with the page to be turned in said book, said means including a pusher to engage an exposed page to be turned and to slidably push said page against another for developing a bulge therein, a page-turning means movably mounted within said housing and arranged to sequentially operate with said page-separating means, said page-turning means located to engage and displace said bulge, operating means interconnecting said page-separating means and said page-turning means for reciprocating back and forth movements and to different extents; and page hold-down means arranged within said compartment for direct engagement with said page, whereby said book is held in an open, readable mode.

2. An automatic page-turning apparatus for books and the like, wherein the apparatus comprises:

a housing having a plurality of walls defining a compartment wherein a book is removably disposed;

a page-separating means operably mounted within said compartment for direct contact with the pages to be turned in said book;

a page-turning means movably mounted within said housing and arranged to sequentially operate with said page-separating means;

operating means interconnecting said page-separating means and said page-turning means in a sequential manner;

wherein said operating means comprises:

a central shaft rotatably mounted to one wall of said housing;

a slip-clutch disc fixedly supported on said shaft;

a cable system operably connected to said slip-clutch disc and having said page-turning means attached thereto for movement therewith;

a disc-wheel having a cam recess disposed therein, said disc-wheel being freely supported on said shaft for rotation thereon adjacent said slip-clutch for operable engagement;

linkage means interconnecting said disc-wheel to said page-separating means, whereby said page-separating means is operated when said disc-wheel is rotated about said shaft by said slip-clutch disc; and means connected to said central shaft for rotation of said shaft; and page hold-down means arranged within said compartment for direct engagement with said pages whereby said book is held in an open, readable mode.

3. An automatic page-turning apparatus as recited in claim 2, wherein said page separating means comprises:

a roller arranged for frictional engagement with the page to be turned, when said roller is moved in a forward direction, to turn said page;

wherein the roller is permitted to freely rotate about its axis when moving in a rearward direction, without affecting the contacting page therewith; and means disposed in said roller to limit the rotation of said roller in one direction.

4. An automatic page-turning apparatus as recited in claim 3, wherein linkage means comprises:

a linking arm having a connecting pin located at one end thereof and adapted to be operably received in said cam recess of said disc-wheel, the opposite end of said linking arm being interconnected to said roller, whereby said roller is moved in a linear direction with said linking arm; and spring-biasing means attached to said linking arm to cause said linking arm and said roller return to a normal position after being moved by said disc-wheel to a pre-determined point.

5. An automatic page-turning apparatus as recited in claim 4, wherein said page-turning means comprises:

a band transversely positioned across said compartment in the forward area thereof adjacent the previously turned pages;

a pair of oppositely disposed rail members secured to said housing having a substantially curvilinear configuration, wherein the forward end thereof is positioned in a lower plane than the rearward plane thereof, the rearward plane being located above and adjacent the pages to be turned, thereby allowing said page to clear the band when said page is being separated for turning; and a guide block slidably mounted to each of said rail members and connected to said cable system for movement therewith, wherein the ends of said band are secured to respective guide blocks.

6. An automatic page-turning apparatus as recited in claim 5, wherein said slip-clutch disc includes:

a pair of circumferential grooves disposed therein; and a projecting stud member affixed to said slip-clutch disc for engagement with said disc-wheel, wherein said disc-wheel includes a recess having a predetermined length disposed on the peripheral edge thereof and arranged to receive said stud member therein, whereby said stud member engages the terminating ends of said recess to provide delayed movement of said disc relative to said slip-clutch disc.

7. An automatic page-turning apparatus as recited in claim 6, wherein said cable system comprises:

a plurality of pullies mounted within said housing;

a monofilament cable sequentially engaging said pullies and having one end thereof secured to one groove in said slip-clutch disc, and the other end secured to the other said groove, wherein said cable is so arranged as to provide a pair of parallel cable sections oppositely disposed to each other longitudinally within said compartment and adapted to move simultaneously together in a forward and rearward direction; and biasing means attached to said cable and housing.

8. An automatic page-turning apparatus as recited in claim 7, wherein said page hold-down means comprises:

a first hold-down band transversely positioned within the compartment for releasable engagement with the page to be turned, and a second hold-down band transversely positioned within the compartment for releasable engagement with the opposite disposed pages of the book.

9. An automatic page-turning apparatus as recited in claim 8, wherein said linkage means includes:

a stabilizing leg member connected to said linking arm; and a second biasing spring arranged between said stabilizing leg and said roller, thereby providing a continuous frictional engagement between said roller and said page to be turned, whereby the forward movement of said roller causes said page to bow upwardly, allowing said page-turning band to engage the separated page.

10. An automatic page turning apparatus as recited in claim 9, wherein said first hold-down band includes:

a transversely positioned rod rotatably mounted to said housing walls;

a pair of oppositely disposed leg members affixed to said rod, having said first band secured therebetween; and a biasing spring attached to said rod, providing positive engagement of the band with the page of the book.

11. An automatic page-turning apparatus as recited in claim 10, wherein said apparatus includes:

a transparent top lid hinged to said housing whereby said book can be read when said lid is in a closed, sealed position, said book thereby being protected from damage; and hinge means operably connecting said lid to said housing.

12. An automatic page-turning apparatus as recited in claim 11, wherein the apparatus includes a magnifying means arranged to be mounted within said compartment of said housing.

13. An automatic page-turning apparatus as recited in claim 12, wherein said magnifying means is integrally formed in said lid.

14. An automatic page-turning appratus as recited in claim 11, wherein the apparatus includes a support-mounting means secured to said housing, whereby said apparatus can be mounted under various predetermined conditions.

15. In apparatus for sequentially turning stacked pages of a book or the like, the combination comprising (a) structure forming a zone to receive said pages, (b) a pusher located proximate said zone to engage an exposed page to be turned, (c) and manually operable means operatively connected with the pusher for bodily displacing same generally linearly and with back and forth reciprocation in the direction of page turning, between a first position and a range of subsequent advanced positions, said first position characterized in that the pusher is urged against the exposed page to be turned, and said range of subsequent positions characterized in that the pusher is bodily displaced to frictionally push the exposed page in a turn direction causing its sliding against another page and resulting in progressive upward bulging of that page while sliding over the surface of the next below page beneath the pusher.

16. The combination of claim 15 wherein the pusher comprises a rotor, and including a one-way clutch associated with the rotor to block rotor-rotation as the rotor is bodily displaced in said direction, and accommodating rotor rotation as the rotor is returned to its initial position by the actuator, and structure yieldably urging the rotor toward the exposed page to be turned.

17. The combination of claim 15 including said stack of pages, and means to hold said stack of pages in said zone.

18. The apparatus of claim 15 wherein said means includes a member reciprocable in said page turning direction and in a return direction, and a manually displaceable part connected with said member to reciprocate same.

19. The combination of claim 18 including said stack of pages in said zone, said member located proximate page edges.

20. The combination of claim 18 wherein said part comprises a manually rotatable handle, said structure including a receptacle outside which said handle projects, said member located in said receptacle.

21. In apparatus for sequentially turning stacked pages of a book or the like, the combination comprising (a) structure forming a zone to receive said pages, (b) a page flipper proximate said zone to engage an exposed page to be turned, (c) and manually operable means operatively connected with the flipper for bodily displacing same along a generally linear path and with back and forth reciprocation between retracted and advanced positions, said advanced position characterized in that the flipper is temporarily maintained overlying an already turned page, said flipper being retracted while a page to be turned is urged in a turn direction and is progressively bulged upwardly, said path of flipper displacement between retracted and advanced positions characterized in that the flipper is brought into engagement with the bulged page to be turned and said flipper the flips said page over and beneath the flipper as the flipper is displaced.

22. The combination of claim 21 including said stack of pages, and means to hold the stack of pages in said zone during displacement of said flipper.

23. The combination of claim 21 wherein said manually operable means includes manually displaceable structure operatively connected with said flipper to displace same between said advanced and retracted positions.

24. The combination of claim 21 including a page pusher to which said manually operable means is also operatively connected.

* * * * *